US008869871B2

(12) United States Patent
Massey

(10) Patent No.: US 8,869,871 B2
(45) Date of Patent: Oct. 28, 2014

(54) SCREEN ATTACHMENT HANDLE WITH LATCH

(75) Inventor: Victor Massey, Orting, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 73 days.

(21) Appl. No.: 13/569,449

(22) Filed: Aug. 8, 2012

(65) Prior Publication Data

US 2014/0041323 A1 Feb. 13, 2014

(51) Int. Cl.
*A47G 5/00* (2006.01)

(52) U.S. Cl.
USPC ..... 160/371; 160/269; 292/163

(58) Field of Classification Search
USPC ..... 160/370, 369, 90, 371; 49/57, 463, 465, 49/62; 292/137, 163, 175, 67, DIG. 63, 292/DIG. 61
See application file for complete search history.

(56) References Cited

U.S. PATENT DOCUMENTS

| | | | | | |
|---|---|---|---|---|---|
| 160,525 | A | * | 3/1875 | Husted | 292/332 |
| 672,397 | A | * | 4/1901 | Gracey | 292/67 |
| 1,046,336 | A | * | 12/1912 | Schatz | 292/114 |
| 1,198,862 | A | * | 9/1916 | McCormack | 292/332 |
| 1,249,176 | A | * | 12/1917 | Newman | 292/67 |
| 1,521,572 | A | * | 12/1924 | Hammer et al. | 292/175 |
| 2,204,761 | A | * | 6/1940 | Lang | 160/369 |
| 2,523,559 | A | * | 9/1950 | Couture | 292/67 |
| 3,129,470 | A | * | 4/1964 | Schneider | 49/450 |
| 5,431,211 | A | * | 7/1995 | Guillemet | 160/381 |
| 5,524,944 | A | * | 6/1996 | Berg | 292/163 |
| 6,109,331 | A | * | 8/2000 | Story, Jr. | 160/371 |

* cited by examiner

*Primary Examiner* — Blair M. Johnson
(74) *Attorney, Agent, or Firm* — Rathe Lindenbaum LLP

(57) ABSTRACT

A screen assembly is configured to be removably secured to an architectural opening. The screen assembly includes a screen frame having a screen member coupled thereto. A latch mechanism includes a latch member movable relative to the screen frame from an engaged position to a disengaged position along a given linear axis. The latch assembly rotates about a pivot perpendicular to the linear axis to lock the latch assembly in the disengaged position.

20 Claims, 13 Drawing Sheets

SCREEN ATTACHMENT HANDLE WITH LATCH

CROSS-REFERENCE TO RELATED PATENT APPLICATIONS

None.

BACKGROUND OF THE INVENTION

The present invention relates generally to the field of window screen latch mechanisms and, more particularly, to spring-biased screen latch. Screen latches are used to secure a screen to a window frame so that the screen may be installed and removed depending on the season and desired use by an occupant.

SUMMARY OF THE INVENTION

A screen assembly is configured to be removably secured to an architectural opening. The screen assembly includes a screen frame having a screen member coupled thereto. A latch mechanism includes a latch member movable relative to the screen frame from an engaged position to a disengaged position along a given linear axis. The latch assembly rotates about a pivot perpendicular to the linear axis to lock the latch assembly in the disengaged position.

In another embodiment a screen assembly is configured to be removably secured to an architectural opening. The screen assembly includes a screen frame having at least one lineal member and a screen coupled thereto. The lineal member has a longitudinal axis. The lineal member has a first wall that extends along the longitudinal axis. A latch mechanism includes a latch member and a handle that are movable relative to the screen frame from an engaged position to a disengaged position along an axis perpendicular to the longitudinal axis of the lineal member. The latch assembly rotates about a pivot axis perpendicular to the linear axis and perpendicular to the longitudinal axis to lock the latch assembly in the disengaged position. The handle is located on a first side of the first wall and the latch member is located on a second side of the first wall opposite the first side. The handle is located completely within a periphery of the first wall in both the engaged and disengaged position. A spring biases the latch mechanism toward the engaged position.

In another embodiment a method of removably securing a screen assembly to an architectural includes providing a screen assembly that has a screen frame with at least one lineal and a screen coupled thereto. The lineal member has a longitudinal axis and a first wall extending along the longitudinal axis. A latch mechanism is provided and includes a biased latch member and a handle operatively coupled to the screen frame. A spring biases the latch member and handle in a first direction perpendicular to the longitudinal axis of the lineal member. The handle is slid along the lineal axis in a direction opposite the first direction until the latch member disengages from the architectural opening. The handle is rocked in a direction about the longitudinal axis of the lineal member until a notch on the latch mechanism catches a portion of the lineal thereby locking the latch mechanism in the disengaged position. The screen assembly may then be removed from the architectural opening.

DETAILED DESCRIPTION

Figure 1:
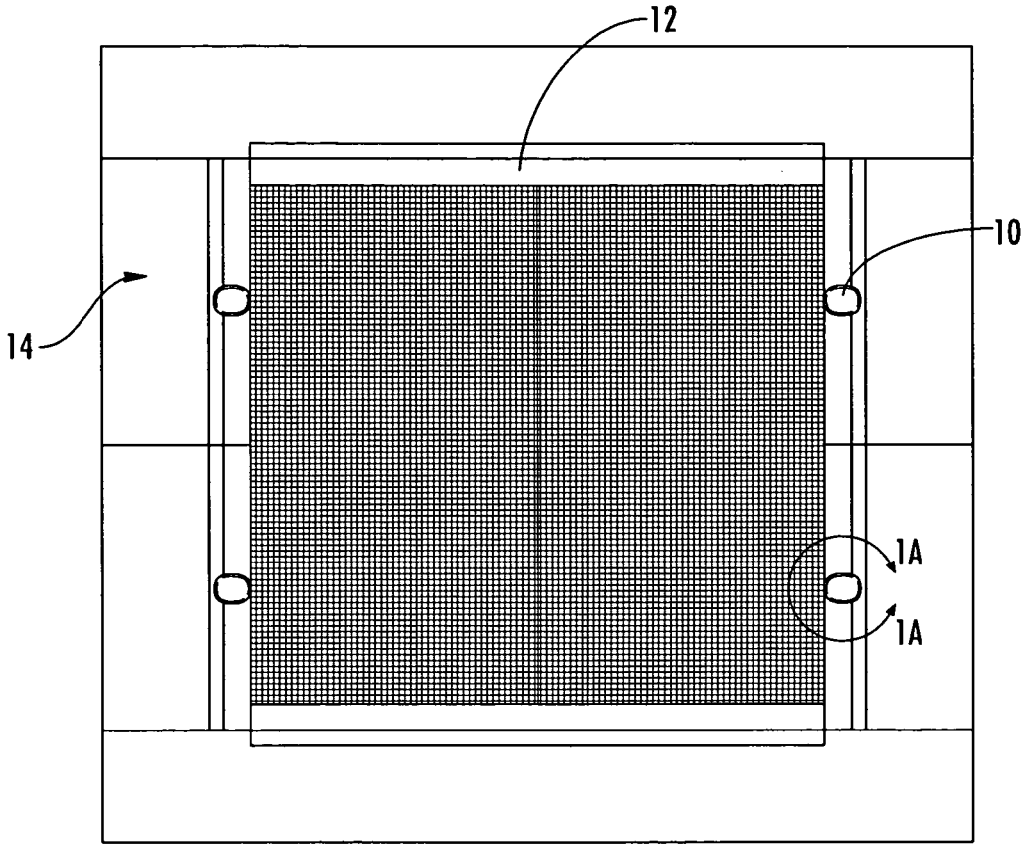
FIG. 1 is a front plan view of a screen assembly secured to a frame.
Figure 1A:
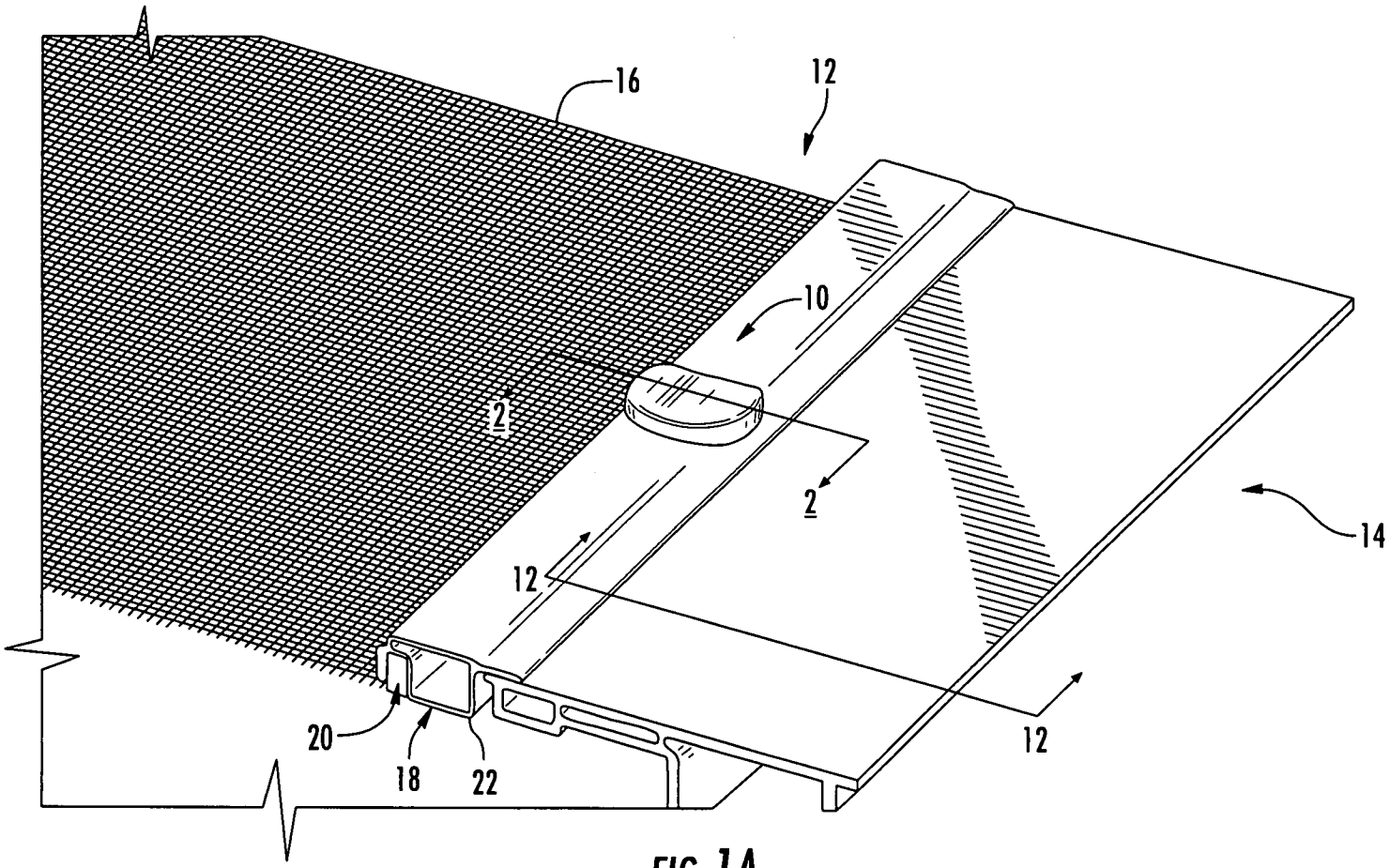
FIG. 1A is an isometric partial view of a latch mechanism.

Referring to FIGS. 1 and 1A, a latch mechanism 10 is configured to removably secure a screen assembly 12 to an architectural frame 14 such as a window frame or door frame. Screen assembly 12 comprises a flexible membrane or screen 16 attached to a screen frame 18 with an attachment device or spline 20. Screen frame 18 includes a screen frame member or lineal 22. Screen assembly 12 when secured to architectural frame 14 separates the inside of a building with the outside of the building, or separates one part of an architectural structure from another part of the architectural structure. At least one latch mechanism 10 is coupled to lineal 22 to removably secure screen assembly 12 to architectural frame 14.

Figure 4:
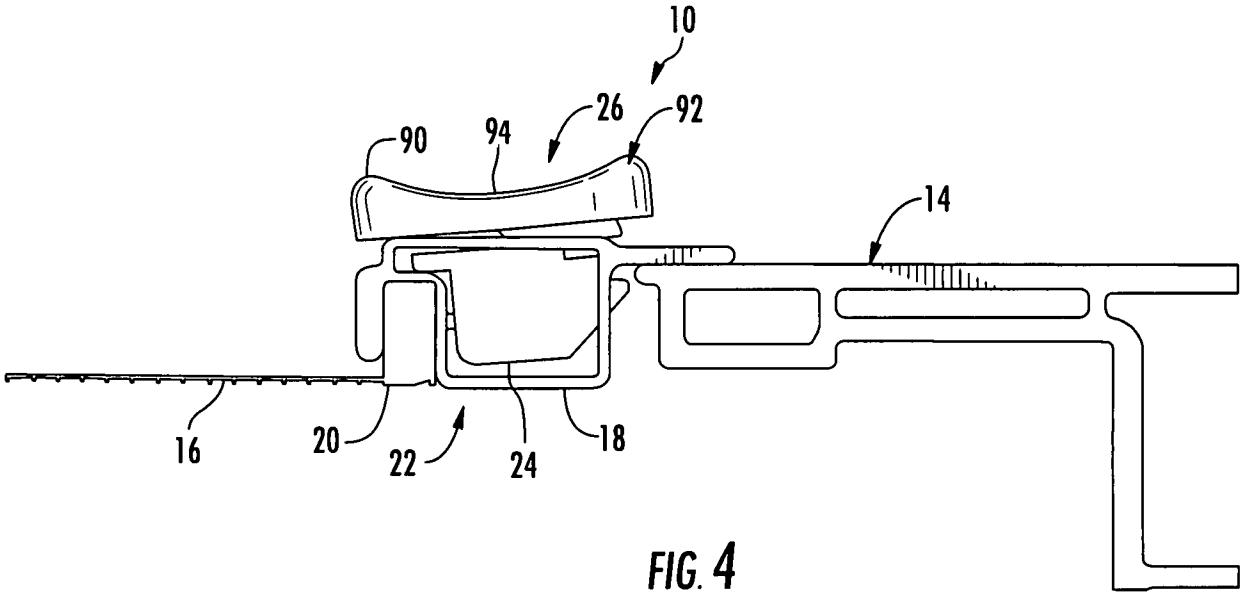
FIG. 4 is a cross-sectional view of the latch mechanism of FIG. 2 in a locked position.
Figure 5:
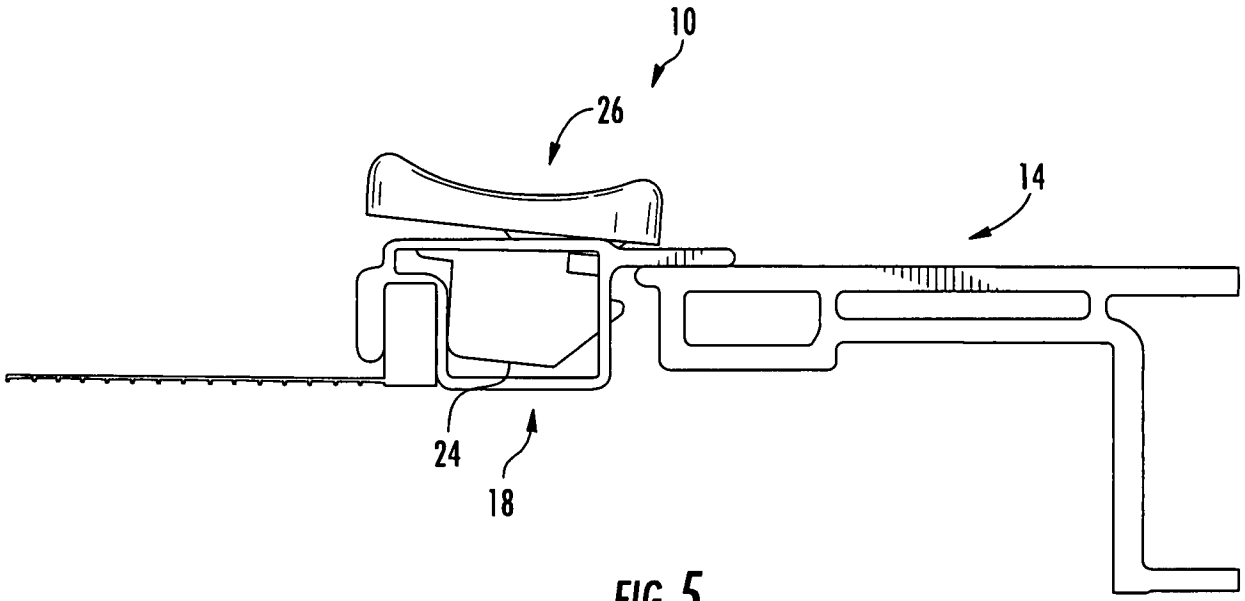
FIG. 5 is a cross-sectional view of the latch mechanism of FIG. 2 in a rocked position.

Latch mechanism 10 may be used to secure a screen to a window or door. Typically, a window or door with a screen is installed in a vertically-oriented, exterior wall of a building structure separating an inside space from an outside space. While latch mechanism 10 may be used to secure a screen assembly to different types of windows and doors and in different locations and orientations on the structure, latch mechanism 10 will be described relative to a screen assembly secured to a window in an exterior wall of a structure with the screen assembly 12 being secured to the frame from the inside of the structure. The direction "up" or "upward" is used to reference a general vertically-oriented vector direction away from the force of gravity while the term "down" or "downward" is used to reference a general vertically-oriented vector direction toward the force of gravity. The direction "in" or "inward" is used to reference a general horizontally-oriented vector direction toward the inside of the structure. The direction "out" or "outward" is used to reference a general horizontally-oriented vector direction toward the outside of the structure. The term "front" or "inside" is used to describe the surface that a person would see facing the window from the inside of a building structure while the term "rear" or "outside" is used to describe the surface that a person would see facing the window from the outside of a building structure. With respect to lineal member 22, the term "inboard" is used to describe the area inside the form or shape created by lineal member 22, while the term "outboard" is used to describe the area outside the form created by lineal member 22. "Inboardly" and "outboardly" define directions moving toward the inboard area or toward the outboard area, respectively Referring to FIGS. 2 and 3, latch mechanism 10 includes a bolt or latch member 24 and a handle 26 that are movably coupled to lineal 22 in a sliding motion along a linear axis 28 between an engaged position and a disengaged position with respect to architectural frame 14. In one embodiment a plurality of latch mechanisms 10 are located about screen assembly 12. Referring to FIG. 4, Latch mechanism may be rocked to a locked position when latch mechanism 10 is in the disengaged position to maintain latch mechanism 10 in the disengaged position when a user releases handle 26. Referring to FIG. 5, latch mechanism 10 may be rocked to an unlocked position to allow latch mechanism 10 to move to the engaged position.

Latch mechanism 10 provides easy operation for removably securing screen assembly 12 to architectural frame 14. Screen assembly 12 is secured or attached to architectural frame 14 from inside the structure with handle 26 also facing inside the structure and facing a user. To attach screen assembly 12 to architectural frame 14, a user positions screen assembly 12 into alignment with the corresponding opening in architectural frame 14 and exerts a force on screen lineal members 22 toward architectural frame 14 in the outside direction. The position of handle 26 automatically adjusts as latch member 24 engages architectural frame 14.

As will be described in detail below, handle 26 of latch mechanism 10 responds to the force of the screen being pressed into architectural frame 14 by sliding along axis 28 generally inboardly within lineal 22 as latch member 24 engages architectural frame 14, and then moves outboardly once latch member 24 clears architectural frame 14. Handle 26 ceases movement in the engaged position, correlating to completion of attachment of screen assembly 12 to architectural frame 14. To detach screen assembly 12 from frame 14, the user manipulates handle 26. First, the user slides handle 26 inboardly to the disengaged position. Secondly, the user rocks handle 26 about an axis 34 substantially parallel to or co-linear with a longitudinal axis 44 of lineal 22. As a result latch mechanism is pivoted to the locked position. With latch member 24 in the locked position, the user ceases manipulation of handle 26 and removes screen assembly 12 from architectural frame 14. Latch mechanism 10 will remain in the locked position until the user manipulates handle 26 by rocking handle 26 to the unlocked position thereby releasing latch mechanism 10 from the locked position. Prior to reattachment of screen assembly 12 to architectural frame 14, the user preferably releases latch mechanism 10 from locked position by rocking handle 26 in the opposing direction that the handle was rocked to lock the latch mechanism, thereby pivoting latch mechanism 24 in the opposing direction about axis 34 to the unlocked position. When released, latch member 24 and handle 26 is spring biased to the extended engaged position in preparation for reattachment of screen assembly 12 to architectural frame 14. In the event the user fails to rock handle 26 to unlock latch member 24 prior to commencement of reattachment, the user may alternatively unlock latch mechanism 10 after positioning screen assembly 12 into alignment with architectural frame 14.

Figure 3:
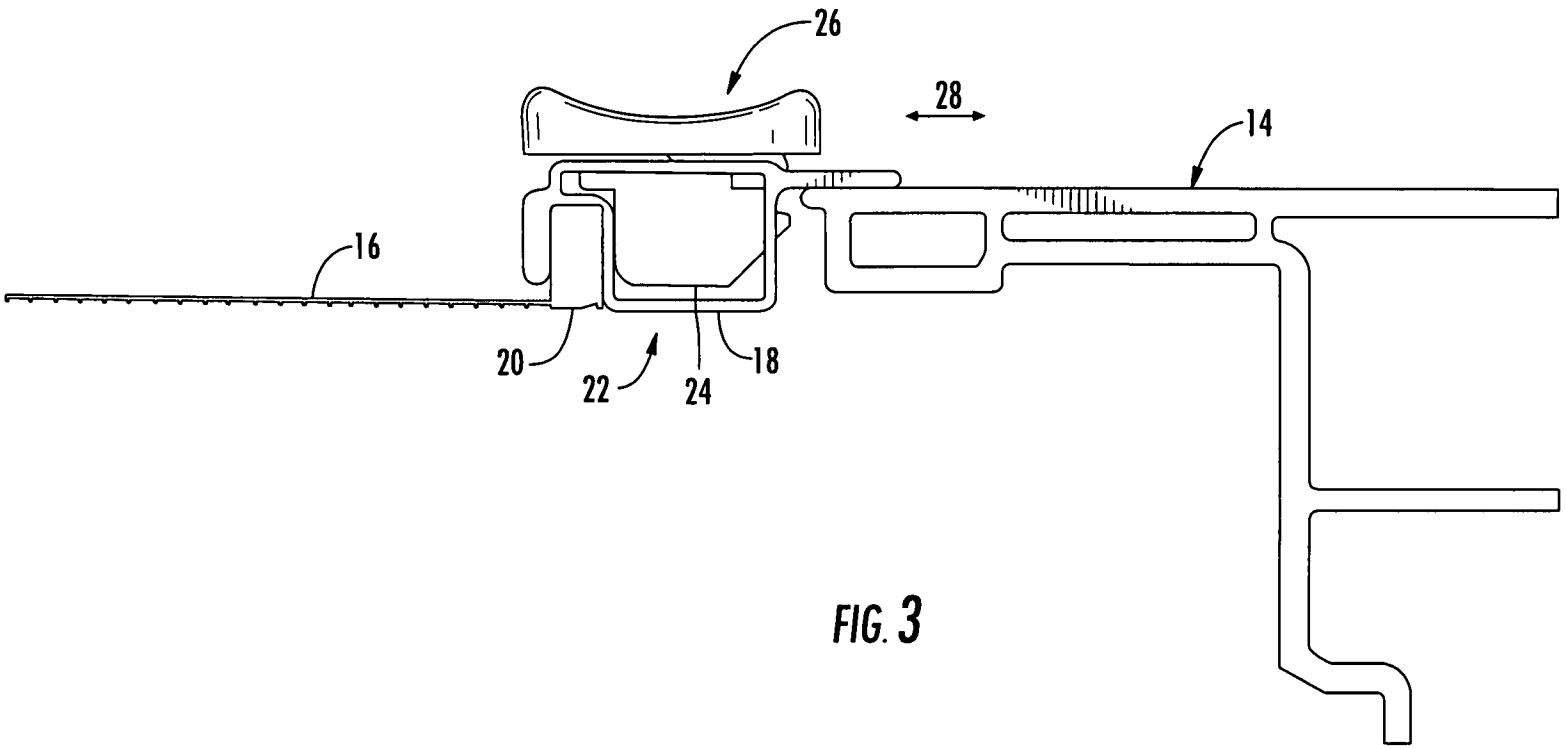
FIG. 3 is a cross-sectional view of the latch mechanism of FIG. 2 in a disengaged position.

Referring to FIG. 3 flexible membrane or screen 16 provides a separation between two areas, including between two rooms or areas within a building structure and between the inside of a building structure and the outside of the building structure. Screen 16 may be constructed of a material with characteristics including, but not limited to, the following: permeable, impermeable, metallic, plastic, fabric, opaque, translucent, transparent, woven. Screen 16 may also include decorative elements including, but not limited to, designs and artwork. In one embodiment, screen 16 may be of a permeable material and located in an exterior building wall, thereby allowing air circulation between the inside and outside of the building. In another embodiment, screen 16 may be of a permeable material and located in an interior building wall, thereby allowing air circulation between two rooms within a building. In yet another embodiment, screen 16 may be of a translucent material with an included artistic design, thereby providing visual and aesthetically-pleasing privacy between two rooms within a building.

Screen frame 18 is a substantially rigid component or structure, including at least one lineal 22, configured to receive and support screen 16 and to interface with architectural frame 14. Screen frame 18 has a shape corresponding to the shape of architectural frame 14 and a configuration to accept screen 16 and spline 20 such that screen 16 spans the area contained within the shape or inboard area of screen frame 18. In one embodiment, screen frame 18 may include four lineals, creating a rectangular or square shape. In another embodiment, screen frame 18 may include three lineals, creating a triangular shape. In other embodiments, screen frame 18 may include other quantities of lineal 22, creating other shapes, including, but not limited to, pentagon, hexagon and octagon.

Screen attachment or spline 20 removably secures screen 16 to screen frame 18. Spline 20 comprises a component of compressible material of a substantially consistent cross-sectional area and of a length sufficient to circumnavigate the perimeter of the shape of screen frame 18 proximate the inboard area. Spline 20 retains screen 16 to screen frame 18 by compressive fitment of spline 20 into an area of screen frame 18 with a cross-sectional area that is smaller than the cross-section of spline 20. Spline 20 and screen 16 are removable from frame 18 substantially without damage to spline 20, screen 16 or frame 18.

Figure 6:
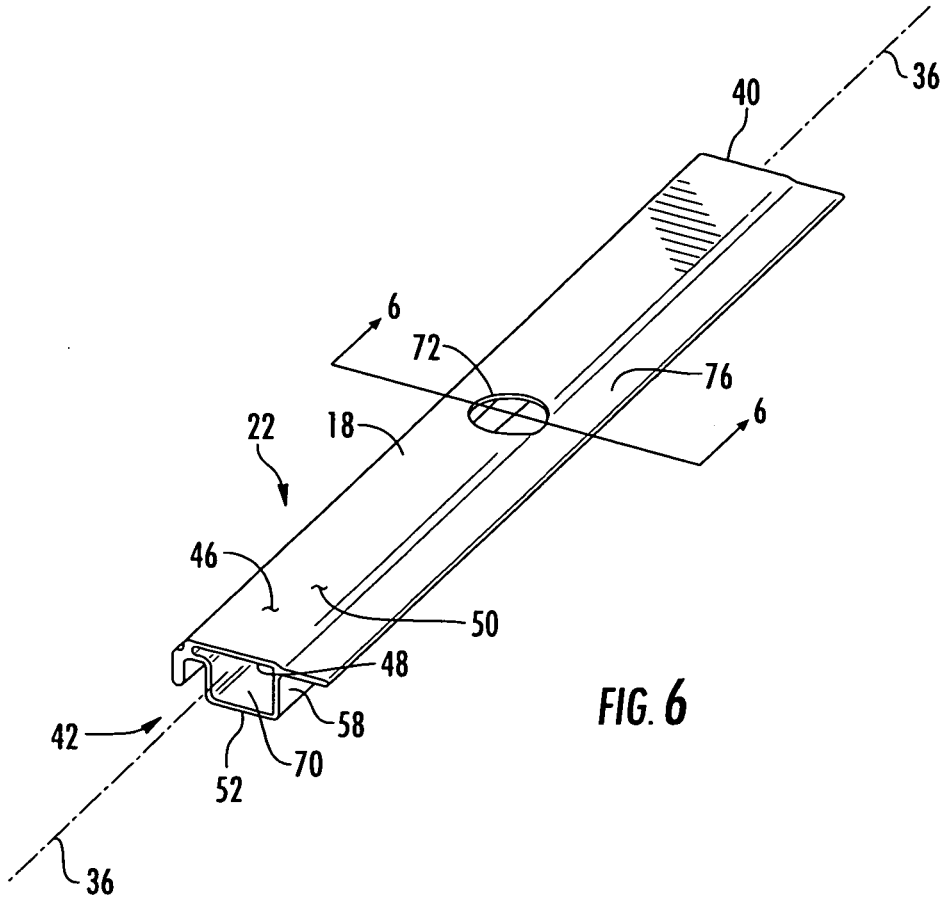
FIG. 6 is an isometric view of a lineal component of the latch mechanism of FIG. 1.
Figure 7:
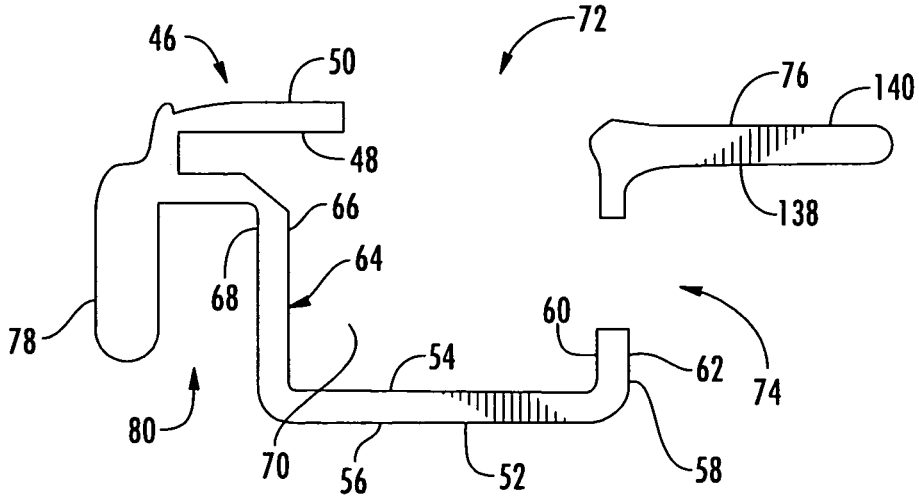
FIG. 7 is a cross-sectional view of the lineal component of FIG. 6 taken along lines 7-7 of FIG. 6.

Referring to FIGS. 6 and 7, screen member or lineal portion or lineal 22 is a substantially rigid component of screen frame 18 configured to removably secure latch mechanism 10 and to engage with architectural frame 14. Lineal 22 includes a first end 40, a second end 42 and a longitudinal axis 36 extending between first end 40 and second end 42. Lineal 22 comprises members that extend between first end 40 and second end 42 including a first wall 46, the first wall 46 includes a first or interior surface 48 and a second opposing front or exterior surface 50; a second wall 52 spaced from and parallel to first wall 46. Second wall 52 includes a first or interior surface 54 and a second or exterior surface 56; a third wall 58, includes a first or interior surface 60 and a second or exterior surface 62. A fourth wall 64 is spaced from and parallel to third wall 58, the fourth wall 64 includes a first or interior surface 66 and a second or exterior surface 68. Third wall 58 and fourth wall 64 extend generally perpendicular to first wall 46 and second wall 52. A cavity 70 is formed by the first wall 46, second wall 52, third wall 58 and fourth wall 64. A first opening 72 extends through first wall 46 and a second opening 74 extends through third wall 58 proximate to first opening 72. First opening 72 and second opening 74 are located intermediate first end 40 and second end 42. In one embodiment, first opening 72 and second opening 74 each comprise a circular opening formed from a standard drill bit. In another embodiment, at least one of first opening 72 and second opening 74 may be noncircular or may be formed by an alternate machining method.

Lineal 22 also includes a flange or lineal extension 76 extending from first wall 46. Lineal extension 76 includes a first side 138 proximate third wall 58 and an opposing second side 140 distal third wall 58. In one embodiment lineal extension 76 is substantially coplanar with first wall 46. In another embodiment, lineal extension 76 may be located in a plane spaced from and substantially parallel to first wall 46. A spline flange 78 extends from first wall 46 and is substantially perpendicular to first wall 46. Spline flange 78 is spaced from and substantially parallel to fourth wall 64. A spline groove 80 is formed between spline flange 78 and fourth wall 64. Spline groove 80 is configured to receive a peripheral portion of screen 16 and spline 20. Spline groove 80 is external to cavity 70 and distal first opening 72, second opening 74, and lineal extension 76. A retaining groove or retaining channel 82 is extends from cavity 70 and is formed by first wall 46 and a fifth wall 84 extending between fourth wall 64 and spline flange 78.

Figure 8:
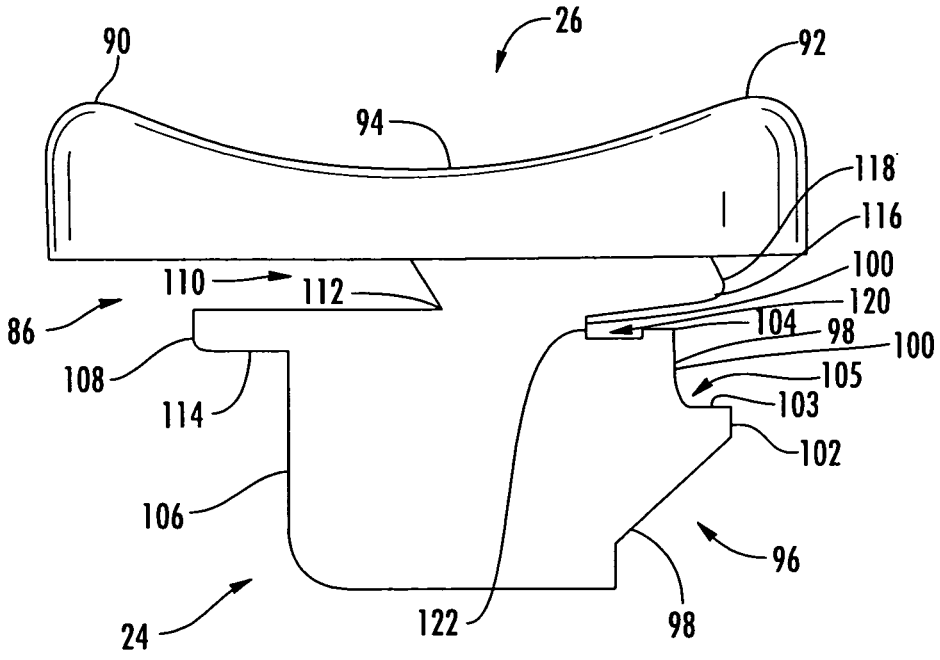
FIG. 8 is a side view of a latch component of the latch mechanism of FIG. 1A.

Referring to FIG. 8, latch mechanism 10 is configured to be removably coupled to lineal 22 and to engage with architectural frame 14. Latch mechanism 10 includes latch member 24, handle 26, and a retaining portion 86. Retaining portion 86 is intermediate latch member 24 and handle 26. A Spring member or spring 88 extends from latch member 24. The latch member 24, handle 26, and retaining portion 86 are secured together in a fixed arrangement. In one embodiment, latch member 24, handle 26, and retaining portion 86 comprise a unitary body of solid material. In another embodiment, latch member 24, handle 26, and retaining portion 86 may be individual components permanently secured to one another. In yet another embodiment, at least one of latch member 24, handle 26, and retaining portion 86 may be constructed of nonsolid material. In one embodiment, one or more of latch member 24, handle 26, and retaining portion 86 may be constructed of a resilient material including, but not limited to, a polymer material.

Handle 26 is a component configured for manipulation by a user to create movement along axis 28 and about rocking axis 34. Handle 26 includes a first end or spring end 90 and a second end or engagement end 92 and a thumbrest surface 94 intermediate first end 90 and an opposing second end 92. In one embodiment, surface 94 may be concave or recessed relative to ends 90 and 92. In another embodiment, surface 94 may have another shape relative to ends 90 and 92, the shape including, but not limited to, flat.

Latch member 24 is a component configured to engage with architectural frame 14. Latch member 24 is dimensionally configured to fit substantially within cavity 70. Latch member 24 comprises a first side or engagement region 96, the engagement region 96 includes a beveled surface or ramp 98 terminating at a nose 102, a horizontal surface 103 extends from nose 102 to a substantially vertical catch surface 100. Horizontal surface 103 and vertical catch surface 100 form a notch 105. Catch surface 100 terminates at an upper end with a substantially horizontal surface 104. Latch member 24 also includes a second side or spring wall 106. Engagement region 96 and spring wall 106 are configured on opposing sides of latch member 24 in a fixed arrangement. Movement of spring wall 106 results in correlating movement of engagement region 96.

Retaining portion 86 is configured in combination with latch member 24 and handle 26 to retain latch mechanism 10 in a given position relative to lineal 22. Retaining portion 86 comprises a first end or retaining member 108 adjacent extending from spring wall 106 in a direction away from engagement region 96. A guide groove 110 is formed between a bottom of handle 26 and retaining member 108. Retaining member 108 includes an upper surface 112 facing handle 26 and an opposing bottom surface 114.

Retaining portion 86 further includes a retaining flange 116 extending from the bottom of handle 26. Retaining flange 116 includes an engagement surface 118 extending from the bottom of handle 26 to the bottom of retaining flange 116. Engagement surface 118 may be perpendicular to the bottom of handle 26 or may form an angle with respect the bottom of handle 26 forming a lock notch 119. A groove 120 is formed between the bottom of retaining flange 116 and upper surface 104 of latch member 24.

Spring member 88 is a component configured to bias latch mechanism 10 along axis 28 in an outboardly direction into engagement with architectural frame 14. Spring 88 is attached to spring wall 106. Spring wall 106 may include a bore or other fastening mechanism to secure or locate spring 88 to latch member 24. The spring 88 extends substantially perpendicular from surface of spring wall 106. In one embodiment spring 88 is a compression spring that creates a force against surface of spring wall 106 when spring 88 is compressed, resulting in a biasing force of latch member 24 in an outboardly direction along axis 28 from spring region 106 toward engagement region 96.

Figure 9:
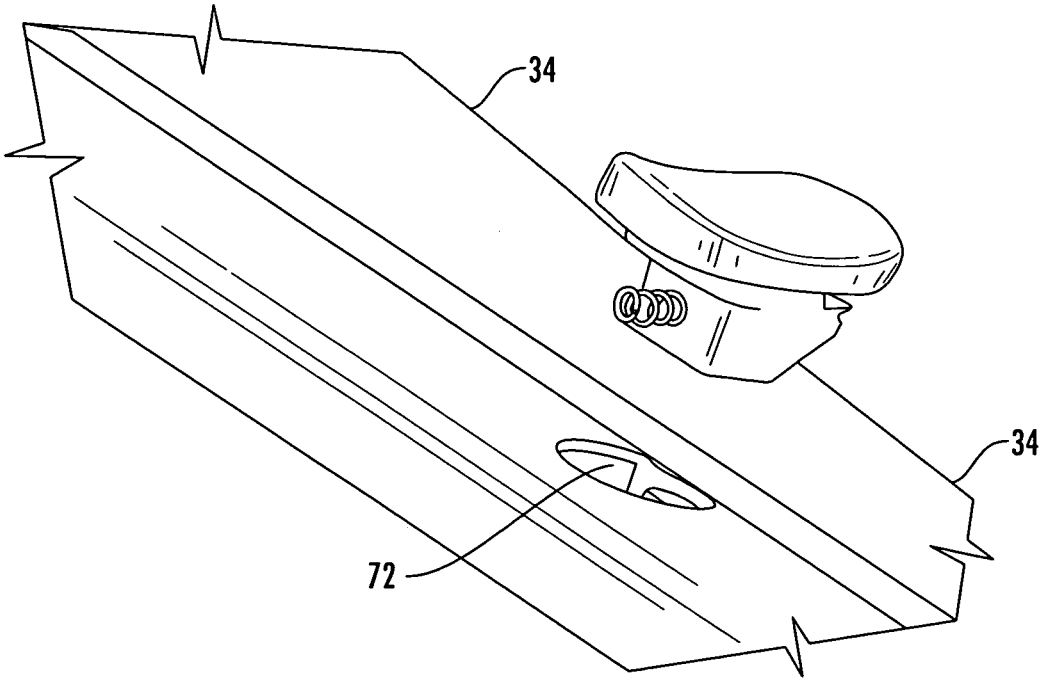
FIG. 9 is an isometric partially-exploded view of the lineal component of FIG. 6 and the latch component of FIG. 8 positioned relative to one another prior to coupling.
Figure 10:
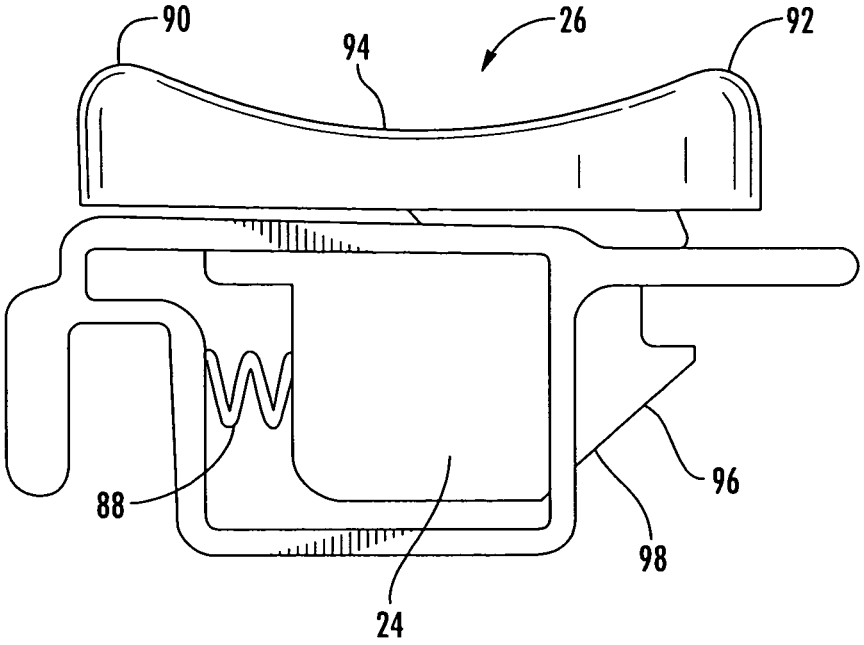
FIG. 10 is an end view of the lineal component of FIG. 6 coupled to the latch component of FIG. 8.
Figure 11:
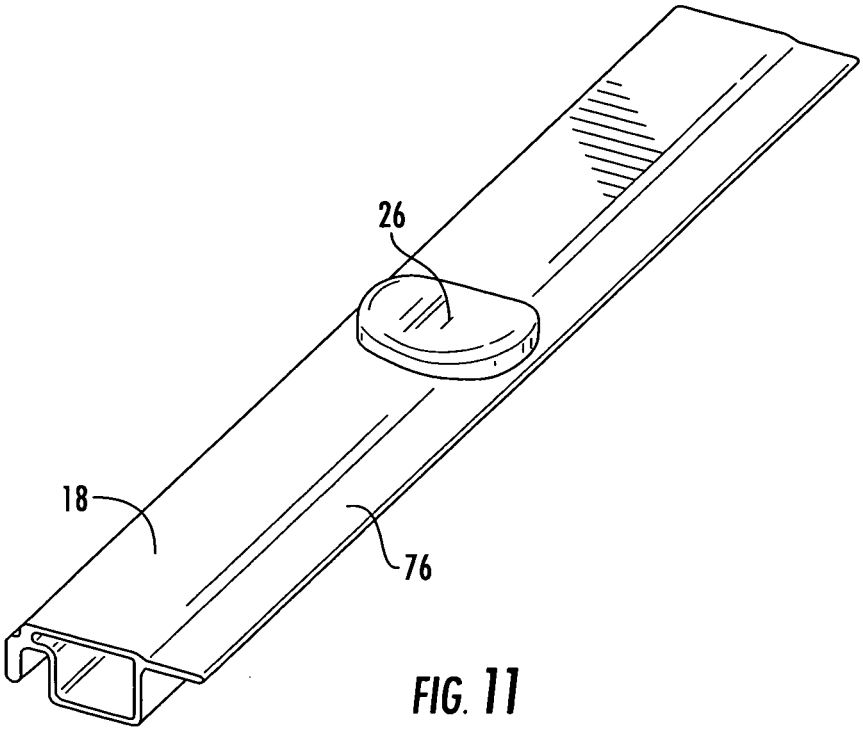
FIG. 11 is an isometric view of the lineal component of FIG. 6 coupled to the latch component of FIG. 8.

Referring to FIGS. 6-11, latch member 24 is removably coupled to lineal 22 intermediate first end 40 and second end 42. Referring to FIG. 9 latch member 24 is positioned relative to lineal 22 in preparation for coupling. Referring to FIGS. 10 and 11 latch member 24 is coupled to lineal 22. In preparation for coupling, latch mechanism 10 is oriented above first opening 72 with latch member 24 proximate first opening 72, with nose 102 pointing toward lineal extension 76 and with spring 88 pointing toward spline groove 80. Manipulation of latch mechanism 10 during coupling occurs substantially by manipulation of handle 26, wherein latch member 24 is inserted into cavity 70 through first opening 72. During coupling, engagement region 96 engages second opening 74, groove 120 receives a portion of lineal extension 76, and retaining groove 110 receives a portion of wall 46 of lineal 22. Spring 88 contacts and/or engages interior surface 66 of fourth wall 64. When fully coupled, spring 88 is compressed by contact with fourth wall 64, thereby biasing engagement region 96 through second opening 74 until contact between wall 122 of groove 120 and lineal extension 76 prevents further movement.

In one embodiment of coupling latch mechanism 10 with lineal 22, prior to insertion of latch mechanism 10 into cavity 70, latch mechanism 10 is tilted or twisted to point the free end of spring 88 toward first opening 72, followed by twisting of latch mechanism 10 in rotating motion about an axis that is generally parallel to the longitudinal axis 36 of lineal 22. In this manner engagement region 96 extends through second opening 74 and groove 120 receives a portion of lineal extension 76.

In another embodiment of coupling latch mechanism 10 with lineal 22, prior to insertion of latch mechanism 10 into cavity 70, latch mechanism 10 may be twisted or rotated to point the free end of spring 88 generally toward one of lineal first end 40 and lineal second end 42, followed by twisting of latch mechanism 10 to allow engagement region 96 to extend through second opening 74 and lip groove 120 receives lineal extension 76.

In yet another embodiment of coupling latch mechanism 10 with lineal 22 a combination of twisting motions may occur. A first twisting motion as latch assembly is inserted through first opening 72 and followed by a second different twisting motion to insert engagement region 96 through second opening 74. In still another embodiment, latch mechanism is coupled to lineal 22 before screen 16 and spline 20 are received in spline groove 80.

Referring to FIGS. 10 and 11, with latch mechanism 10 coupled to lineal 22, handle first end 90 does not extend beyond spline flange 78 and handle second end 92 does not extend beyond a terminal edge of lineal extension 76.

Figure 12:
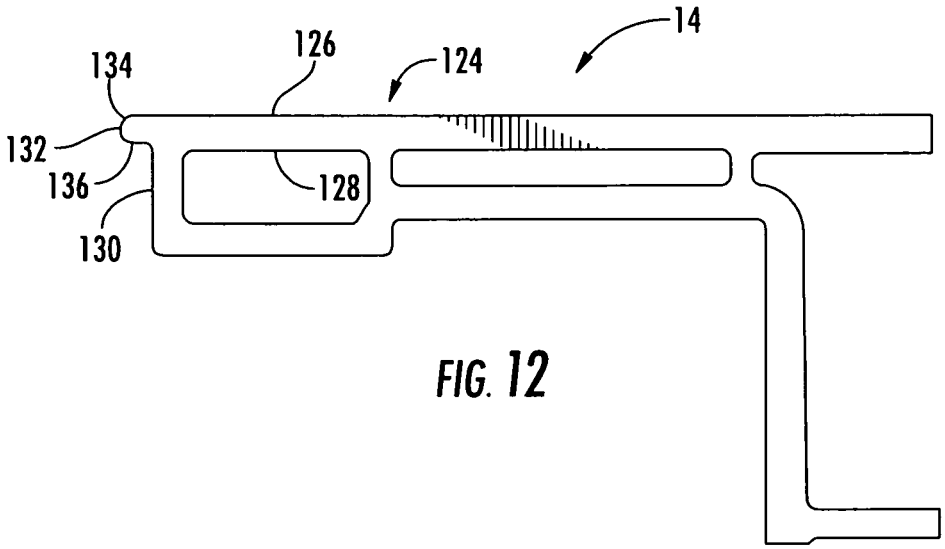
FIG. 12 is a cross-sectional view of an architectural frame component of the latch of FIG. 1A taken along lines 12-12 of FIG. 1A.

Referring to FIG. 12, architectural frame 14 such as a window frame or door frame provides a structure to which screen assembly 12 is removably secured. Architectural frame 14 comprises a wall 124 including a first surface 126 and a second opposing surface 128. Second surface 128 is substantially parallel to first surface 126. Architectural frame 14 includes a third surface 130, the third surface 128 substantially perpendicular first surface 126 and second surface 128. A frame lip 132 extends from the interface of wall 124 and third surface 130. In one embodiment, lip 132 is substantially coplanar with wall 124 and substantially perpendicular to third surface 130. In another embodiment, lip 132 may be spaced from and substantially parallel to wall 124.

Referring to FIGS. 2, 7, 8, 10 and 12, screen assembly 12 is removably secured to architectural frame 14. In preparation for securement, screen assembly 12 is positioned relative to architectural frame 14 with lineal extension 76 proximate frame wall 124 with first side 138 of lineal extension 76 facing first surface 126 of wall 124.

Latch mechanism 10 is located within lineal 22 in the extended unlocked position. In this orientation, ramp 98 of latch member 24 abuts a first surface 134 of lip 132. As a user exerts a force against screen assembly 12 generally toward architectural frame 14 to create movement of lineal extension 76 toward frame wall 124, latch member 24 is forced inwardly into lineal 22 along axis 28 thereby compressing spring 88. Retaining portion 86 and handle 26 correspondingly move with latch member 24 in along axis 28 28 with handle 26 sliding axis 28 away from lineal extension 76. Latch member 24 will continue to travel toward wall 64 of lineal 22 until nose 102 of ramp 98 clears the free end of lip 132. Once nose 102 clears the free end of lip 132 the spring force of spring 88 biases latch mechanism 10 away from wall 64 in toward frame 14 until rear wall 122 of groove 120 contacts the leading edge of first opening 72 in lineal 22. In this engaged position, extension member 76 is located proximate surface 134 of lip 132 and nose 102 is proximate surface 136 of lip 132. In this manner screen assembly 12 is secured to architectural frame 14. The compressive force of spring 88 maintains latch member 24 proximate surface 136 of extension 132 of architectural frame 14.

Figure 2:
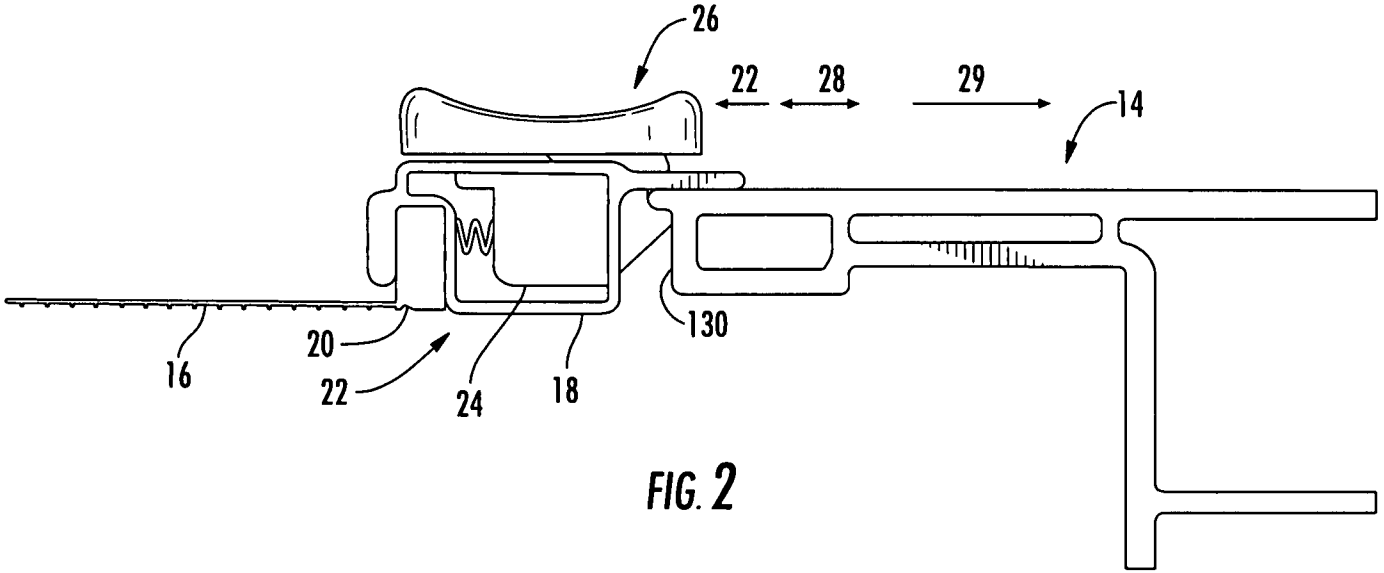
FIG. 2 is a cross-sectional view of the latch mechanism of FIG. 1A in an engaged position taken along lines 2-2 of FIG. 1.

Referring to FIG. 2, nose 102 extends a distance beyond the free edge of lip 132 toward wall 130 of architectural frame 14. This overlap provides for both a secure latch of screen assembly 12 to architectural frame 14. In one embodiment, by design, wall 122 of groove 120 extends an adjustment distance beyond wall 58 of lineal 22. This distance allows for variability in the gap between screen assembly 12 and architectural frame 14 when screen assembly 12 is secured to architectural frame 14. The adjustment distance or range is defined as the distance between surface 62 of third wall 58 of lineal 22 and wall 130 of frame 14. This adjustment range varies relative to dimensional differences between screen assembly 12 and architectural frame 14 and provides a range of adjustment for positioning of screen assembly 12 relative to architectural frame 14.

Referring to FIG. 1, two or more latch mechanisms 10 are secured to opposite vertical lineals 22. As screen assembly 12 is positioned in architectural frame 14, spring 88 of each of the latch mechanisms will assist in centering screen assembly 12 within architectural frame 14 between the two vertical members of architectural frame 14. Similarly, referring to FIG. 2, two or more latch mechanisms may be secured to opposite horizontal lineals. In this embodiment, springs 88 of each of the opposing latch mechanisms in the horizontal lineals will assist in centering screen assembly 12 in the vertical direction.

In another embodiment, screen assembly 12 comprises a quantity of lineals 22, the quantity of lineals 22 including, but not limited to, four and a quantity of latch mechanisms 10, the quantity of latch mechanisms 10 including, but not limited to, four. The quantity of lineals 22 are configured to form a screen frame 18 of a shape including, but not limited to, a rectangle with one or more latch mechanisms 10 being coupled to each lineal 22. Opposing forces exerted by latch mechanisms 10 substantially center screen assembly 12 relative to architectural frame 14.

Referring to FIG. 2 screen assembly 12 is secured to architectural frame 14 in an engaged position. To disengage screen assembly 12 from architectural frame 14, external force is exerted on handle 26 along axis 28 away from architectural frame 14 toward screen 16 moving handle 26 and latch member 24 inboardly and compressing spring 88 until spring wall 106 moves toward lineal fourth wall 64 and latch member 24 is disengaged from frame 14. Referring to FIG. 3 latch member 24 is in the disengaged position and no longer in contact with lip 132 of architectural frame 14.

The term lock as used in this application refers to fixing the position of the latch mechanism 10 in a disengaged position with respect to lineal 22 such that latch member 24 will not engage architectural frame 14 when screen assembly 12 is pressed against architectural frame 14. Referring to FIG. 4, latch mechanism may be moved to a locked position once catch surface 100 moves through second opening 74. Once catch surface 100 moves through second opening toward wall 64, latch mechanism 10 may be rocked to a locked position. When a user applies a force on handle first end 90 toward lineal spline groove 80, latch mechanism 10 rocks or rotates about its axis 34 until latch catch surface 100 catches or engages lineal third wall 58 intermediate lineal first wall 46 and lineal second opening 74. In the locked position, latch retaining member 108 is located within lineal retaining groove 82 and latch catch surface 100 proximate nose 102 is engaged with a peripheral portion of second opening 74. Force exerted by spring 88 maintains contact between catch surface 100 and third wall 58, thereby maintaining latch mechanism 10 in the locked position. In one embodiment, spring 88 contacts wall 106 biasing latch member 24 about axis 34 such that first end 90 of handle 26 is closer to wall 46 than second end 92 of handle 26. With latch mechanism 10 in the locked position, screen assembly 12 may be removed from architectural frame 14 without any interference of latch member 24.

To unlock latch mechanism 10, to allow latch mechanism to extend to an engaged position, an external force is exerted on handle second end 92 toward lineal extension 76, as a result, latch mechanism rocks about pivot axis 34 in a second direction opposite to the first direction when latch mechanism was rocked to the locked position. Referring to FIG. 5, as latch mechanism rocks about pivot axis in the second direction, latch catch surface 100 disengages from lineal third wall 58 and extends through second opening 74. As the external force applied by a user on handle 26 is released, the force exerted by spring 88 moves latch member 24 outboardly along axis 28, such that latch member 98 extends through second opening 74. In this unlocked orientation, screen assembly 12 may be secured to architectural frame 14 as discussed above. It should be noted that if screen assembly 12 is in place against extension member 76 of frame 12, latch member 24 moves directly to the engaged position when latch mechanism is unlocked thereby securing screen assembly 12 to architectural frame 14, without the need to engage ramp or beveled surface or ramp 98 against lip 132 of architectural frame 14.

In another embodiment, screen assembly 12 is positioned to architectural frame 14 prior to release of latch mechanism 10 from the disengaged and locked position. In this position once lineal extension 76 contacts surface 126 of frame wall 124 a user may release the latch mechanism as discussed above. The force of spring 88 will move latch member 24 outboardly along axis 28 until reaching the engaged position.

Referring to FIG. 4, in another embodiment latch mechanism 10 may be rocked to a lock position by rotating latch mechanism 10 about axis 34 is a second direction opposite the first direction. In this embodiment, engagement surface 118 engages a peripheral edge of first opening 72. To release the latch mechanism in this embodiment, the handle 26 is rocked in the first direction to release engagement surface 118 from the first opening 72, allowing the latch member 24 to extend through the second opening 74 by spring 88.

It is important to note that the construction and arrangement of the latch mechanism as described herein is illustrative only. Although only a few embodiments of the present invention have been described in detail in this disclosure, those skilled in the art who review this disclosure will readily appreciate that many modifications are possible (e.g. variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature of number of discrete elements or positions may be altered or varied. Accordingly, all such modifications are intended to be included within the scope of the present invention to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. An apparatus comprising:

a screen assembly configured to be removably secured to an architectural opening, the screen assembly including a screen frame having a screen member coupled thereto; and a latch mechanism including a handle and a latch member movable relative to the screen frame from an engaged position to a disengaged position along a given lineal axis, the latch assembly rotating about a pivot perpendicular to the linear axis to lock the latch assembly in the disengaged position;

the latch including a catch that is releasably engaged with a portion of the screen frame, the catch operatively engaging the screen frame in the locked position, the latch including a first end and an opposing second end, the first end of the latch being closer to a plane defined by the screen than the second end of the latch when the latch is in the disengaged and locked position the latch being biased along the lineal axis, the handle located between the first and second ends.

2. The apparatus of claim 1, wherein the screen frame includes a lineal member having a longitudinal axis, the handle rotating about a pivot that is parallel to the longitudinal axis in a rocking motion.

3. The apparatus of claim 2, wherein the lineal member includes a first end and a second end, the latch assembly being centrally located along the lineal member intermediate the first end and second end.

4. The apparatus of claim 3, wherein the latch mechanism includes a latch member coupled to the handle, and a spring member biasing the latch member toward the engaged position.

5. The apparatus of claim 4, wherein the screen frame includes a lineal member includes a first wall, a second wall spaced from and parallel to the first wall, a third wall and fourth wall spaced from the third wall, the third and fourth walls extending generally perpendicular to the first and second walls, a cavity being formed by the first, second, third and fourth walls, the lineal member having a first opening extending through the first wall and a second opening extending through the third wall; and the latch member of the latch mechanism being received into the cavity through the first opening, the handle being located out of the cavity, the latch member moving through the second opening between the engaged position and disengaged positions.

6. The apparatus of claim 5, wherein the latch member portion includes an engagement region having a beveled surface and a catch surface intermediate the beveled surface and handle, at least a portion of the beveled surface and catch surface extending through the second opening when the latch assembly is in the engaged position.

7. The apparatus of claim 6, wherein the screen assembly is removably secured to an architectural frame lip having a first side and an opposing second side, an extension portion of the screen frame lineal member being positioned adjacent the first side of the architectural frame lip and the latch portion being adjacent the opposing side of the architectural frame lip, when the latch mechanism is in the engaged position.

8. The apparatus of claim 7, wherein the latch assembly includes a retainer intermediate the handle and the latch potion, the retainer being located within the cavity and extending in a direction away from the beveled portion of the latch portion, the retainer being removably and slidably received within a retainer groove in the cavity.

9. The apparatus of claim 8, wherein the screen frame includes a second lineal member parallel to the first lineal member, the second lineal member having a separate second latch assembly and second biasing spring configured to assist in centering the screen frame within an architectural frame.

10. An apparatus comprising:

a screen assembly configured to be removably secured to an architectural opening, the screen assembly a screen frame having at least one lineal member and a screen coupled thereto, the lineal member having a longitudinal axis, the lineal member having a first wall extending along the longitudinal axis; and a latch mechanism including a latch member and a handle movable relative to the screen frame from an engaged position to a disengaged position along a linear axis perpendicular to the longitudinal axis of the lineal member, the latch assembly rotating about a pivot perpendicular to the linear axis and parallel to the longitudinal axis of the lineal member to lock the latch assembly in the disengaged position;

the handle being located on a first side of the first wall and the latch member being located on a second side of the first wall opposite the first side, the handle including a first end and an opposing second end, the first end of the handle being closer to a plane defined by the screen than the second end of the latch when the latch is in the disengaged and locked position; and a spring biasing the latch mechanism toward the engaged position.

11. The apparatus of claim 10, wherein the lineal member has a first longitudinal end and an opposing second longitudinal end, the latch mechanism being located between the first end and the second end of the lineal member and distal from the first end and second end.

12. The apparatus of claim 11, wherein the first wall includes a first opening through which the entire latch member is removably received.

13. The apparatus of claim 12, wherein the lineal member includes a second wall substantially perpendicular to the first wall, the second wall including a second opening through which a portion of the latch member extends, the latch mechanism having a notch formed therein, the notch being releasably engaged with a portion of the lineal member in the disengaged and locked position.

14. The apparatus of claim 13, wherein the screen includes a second lineal member parallel to the first lineal member and spaced therefrom, a second latch mechanism operatively secured to the second lineal member, with a latch member of the second lineal member moving from a disengaged to an engaged position in a direction opposite to the latch member of the first latch mechanism.

15. The apparatus of claim 14, the first latch member and second latch member act to center the screen assembly within the architectural frame.

16. The apparatus of claim 15, wherein the handle of each latch mechanism has a first end and a second end, the first end of the handle being closer to the first wall of each linear member than the second end of the handle when the latch mechanism is in the disengaged and locked position.

17. The apparatus of claim 16, wherein the architectural frame has a lip portion extending therefrom, the lineal including an extension portion being on a first side of the lip and the latch member being on a second side of the lip opposite the first side of the lip when the latch mechanism is in the engaged position.

18. A method of removably securing a screen assembly to an architectural opening comprising:

providing a screen assembly having screen frame with at least one lineal and a screen coupled thereto, the lineal member having a longitudinal axis, the lineal member having a first wall extending along the longitudinal axis; and providing a latch mechanism including a biased latch member and a handle operatively coupled to the screen frame, providing a spring biasing the latch member and handle in a first direction perpendicular to the longitudinal axis of the lineal member the latch having first and second ends, the handle located between the first and second ends;

sliding the handle along a second direction opposite the first direction until the latch member disengages from the architectural opening;

rocking the handle in a direction about the longitudinal axis of the lineal member until a notch on the latch mechanism catches a portion of the lineal thereby locking the latch mechanism in the disengaged position, wherein the handle includes a first end and an opposing second end, the first end of the handle being closer to a plane defined by the screen than the second end of the latch when the latch is in the disengaged and locked position; and removing the screen assembly from the architectural opening.

19. The method of claim 18, further including providing a second latch mechanism on a second lineal member being spaced from and parallel with the first lineal member, repeating the sliding and rocking steps for the second latch mechanism.

20. The method of claim 19, wherein each lineal member has a first end and an opposing second end along each respective longitudinal axis, and further placing the first and second latch mechanism on a center of each respective lineal member.

* * * * *